US008991024B2

(12) United States Patent
Barillaro et al.

(10) Patent No.: US 8,991,024 B2
(45) Date of Patent: Mar. 31, 2015

(54) CLAMPING DEVICE FOR ATTACHING AN EDGE PIECE TO A BENCH TOP, TABLE TOP OR THE LIKE

(75) Inventors: Victor Barillaro, Pascoe Vale (AU); Salvatore Benvenuto Calcagno, Greenvale (AU)

(73) Assignee: Mitreforma Holdings Pty Ltd, Essendon (AU)

( * ) Notice: Subject to any disclaimer, the term of this patent is extended or adjusted under 35 U.S.C. 154(b) by 342 days.

(21) Appl. No.: 13/202,756

(22) PCT Filed: Dec. 1, 2009

(86) PCT No.: PCT/AU2009/001569

§ 371 (c)(1),
(2), (4) Date: Nov. 4, 2011

(87) PCT Pub. No.: WO2010/094055

PCT Pub. Date: Aug. 26, 2010

(65) Prior Publication Data

US 2012/0047714 A1 Mar. 1, 2012

(30) Foreign Application Priority Data

Feb. 20, 2009 (AU) ..... 2009900744
May 14, 2009 (AU) ..... 2009902171

(51) Int. Cl.
*B25B 5/00* (2006.01)
*B25B 5/14* (2006.01)
(Continued)

(52) U.S. Cl.
CPC ..... *B25B 5/142* (2013.01); *B25B 5/101* (2013.01); *B25B 5/16* (2013.01); *B25B 5/163* (2013.01); *B25B 5/166* (2013.01)
USPC ..... 29/281.5; 29/462; 29/559; 29/525.01; 269/140; 269/155; 269/184

(58) Field of Classification Search
CPC ..... B25B 11/02; B25B 27/16; B25B 5/003; B25B 5/006; B25B 5/14; B25B 5/142; B25B 5/10; B23Q 3/06; B23Q 3/061; B23Q 16/001; B23K 37/04; B23K 37/0408
USPC ..... 29/525.01, 462, 559, 50, 281.1, 281.5, 29/281.6; 269/41, 45, 140, 155, 184, 21, 269/235, 37, 8
See application file for complete search history.

(56) References Cited

U.S. PATENT DOCUMENTS 242,959 A 6/1881 Naglee
1,201,888 A 10/1916 Steuber
(Continued)

FOREIGN PATENT DOCUMENTS

CH 608736 A * 1/1979
DE 136209 11/1902
(Continued)

OTHER PUBLICATIONS

International Search Report dated Feb. 24, 2010 for PCT Application No. PCT/AU2009/001569, 2 pages.*
(Continued)

*Primary Examiner* — David Bryant
*Assistant Examiner* — Jun Yoo
(74) *Attorney, Agent, or Firm* — Knobbe, Martens, Olson & Bear LLP

(57) ABSTRACT

There is disclosed a clamping device mountable to a bench top for setting an edge piece to an edge thereof such that the edge piece projects from the bench top at a predetermined angle, with interengaging surfaces of the edge piece and edge being formed with mating mitres whereby a mitre joint is formed between the edge piece and the bench top, the clamping device comprising a body, a first clamping means supported from the body for clamping the device to the bench top, a second clamping means supported from the body for applying clamping pressure to the mitre joint, and first and second locators carried by the body and engageable with the edge piece and bench top respectively to maintain them in the required configuration during clamping. There is also disclosed a related method of attaching an edge piece to an edge of a bench top.

15 Claims, 14 Drawing Sheets

(51) Int. Cl.
*B25B 5/10* (2006.01)
*B25B 5/16* (2006.01)

(56) References Cited

U.S. PATENT DOCUMENTS

| | | | | | |
|---|---|---|---|---|---|
| 1,402,621 | A | * | 1/1922 | Knittel et al. | 269/156 |
| 1,474,119 | A | | 11/1923 | Robertson | |
| 2,440,820 | A | | 5/1948 | Frank | |
| 2,642,905 | A | | 6/1953 | Thomas | |
| 4,165,869 | A | * | 8/1979 | Williams | |
| 5,884,904 | A | * | 3/1999 | Martini | |
| 5,992,836 | A | | 11/1999 | Howe | |

FOREIGN PATENT DOCUMENTS

| | | | |
|---|---|---|---|
| DE | 1726978 | | 7/1956 |
| DE | 1176070 | | 8/1964 |
| KR | 20010023458 | A * | 3/2001 |

OTHER PUBLICATIONS

Extended European Search Report dated Jan. 6, 2014 for European Application No. 09840189.6.
Written Opinion dated Mar. 1, 2010 for PCT Application No. PCT/AU2009/001569.
International Preliminary Report on Patentability dated Aug. 23, 2011 for PCT Application No. PCT/AU2009/001569.

* cited by examiner

CLAMPING DEVICE FOR ATTACHING AN EDGE PIECE TO A BENCH TOP, TABLE TOP OR THE LIKE

FIELD OF THE INVENTION

The present invention relates to attachment of edging to a bench top, table top or the like. The invention has been devised in particular for attachment of edge pieces, particularly aprons or fascias. The invention is applicable to a range of materials and suitable for a range of applications, including masonry and carpentry applications.

In this specification, the term "bench top", "table top", "counter top" or the like generally refers to the item in question before it is provided with the edge piece(s), which item will generally comprise rigid sheeting.

BACKGROUND

To enhance the appearance of a bench/counter top, table top or the like, it is often desirable during manufacture to attach to at least one edge thereof an edge piece, commonly known as an apron or fascia. The edge piece may have a depth which exceeds the thickness of the table/bench top, and may thus, when attached, create an impression that the table/bench top thickness is greater than it actually is, which can favourably influence a perception of robustness of the bench/table top and quality generally.

Formation of the adjoined bench top and edge piece may involve producing a bench/table top edge having a straight outer face which extends through the whole thickness of the bench/table top at right angles to the bench/table top surface, and an edge piece having a rectangular cross-section, and fixing the former and latter together with their outer faces arranged flush. Whilst this is a relatively simple and rapid procedure, it results in a conspicuous join, which may be unsightly. It is thus often preferable that a mitre joint be formed between the edge and edge piece, whereby the join between the edge piece and bench/table top is located at the edge of the bench/table top surface, where it is unnoticeable, or at least less conspicuous.

However, joining the edge and edge piece via a mitre joint, in which both the edge and edge piece are formed with a mitre, is more complicated because it requires not only that the inclined faces of the mitres be brought into engagement, generally with adhesive therebetween, but also that the outer extremities of those faces be precisely positioned so as to be substantially coincident.

There exists a need in the art for an arrangement which facilitates precise joining of a mitred edge piece to a mitred edge of a bench top, table top or the like.

SUMMARY OF THE INVENTION

According to a first aspect of the present invention, there is provided a clamping device mountable to a bench top for setting an edge piece to an edge thereof such that the edge piece projects from the bench top at a predetermined angle, with interengaging surfaces of the edge piece and edge being formed with mating mitres whereby a mitre joint is formed between the edge piece and the bench top, the clamping device comprising a body, a first clamping means supported from the body for clamping the device to the bench top, a second clamping means supported from the body for applying clamping pressure to the mitre joint, and first and second locators carried by the body and engageable with the edge piece and bench top respectively to maintain them in the required configuration during clamping.

In a preferred embodiment of the present invention, the first locator consists of an alignment guide. Preferably, the first locator is configured to abut a surface of the edge piece to maintain the edge piece it in the required orientation during clamping. Preferably, the first locator is configured to abut an outer face of the edge piece.

According to a second aspect of the present invention, there is provided a clamping device mountable to a bench top for setting an edge piece to an edge thereof such that the edge piece projects from the bench top at a predetermined angle, with interengaging surfaces of the edge piece and edge being formed with mating mitres whereby a mitre joint is formed between the edge piece and the bench top, the clamping device comprising a body, a first clamping means supported from the body for clamping the device to the bench top, a second clamping means supported from the body for applying clamping pressure to the mitre joint, and a jig carried by the body and engageable with the edge piece and bench top to maintain them in the required configuration during clamping.

In accordance with a preferred embodiment of the invention the first clamping means comprises a clamping member ("the first clamping member").

In accordance with a preferred embodiment of the invention, the second clamping means comprises a clamping member ("the second clamping member").

In a preferred embodiment of the invention, the jig comprises first and second locators engageable with the edge piece and bench top respectively to maintain them in the required configuration during clamping.

According to a third aspect of the present invention, there is provided a clamping device mountable to a bench top for attaching an edge piece to an edge of the bench top, the edge and edge piece being formed with mating mitres whereby a mitre joint is formed therebetween, the clamping device being configured with a jig engageable with the edge and edge piece to maintain them in the required configuration during clamping.

In a preferred embodiment of the present invention, the jig comprises first and second locators arranged at a predetermined angle, to abut the upper or lower surface of the bench top and an outer side surface of the edge piece respectively, to maintain the edge and edge piece in the required configuration during clamping.

In a preferred embodiment of the invention, the clamping device comprises a clamping means for clamping the device to the bench top ("the first clamping means"). Preferably, the first clamping means comprises a clamping member ("the first clamping member").

In a preferred embodiment of the invention, the clamping device comprises a clamping means for exerting pressure on the edge piece towards the mitre joint ("the second clamping means"). Preferably, the second clamping means comprises a clamping member ("the second clamping member").

In a preferred embodiment of the invention, the clamping device comprises a body from which the clamping means is/are supported.

Preferably, the body comprises a base, and first and second arms which are spaced apart and extend from the base for receipt of the edge therebetween, and the first clamping member is supported from the first arm and operable to effect clamping of the bench top between the clamping member and the second arm to mount the clamp.

Preferably, the first locator is disposed on the base.

Preferably, the second locator is disposed on the second arm.

In many applications, the predetermined angle will be substantially 90 degrees, though may be acute or obtuse.

Preferably, the first locator comprises a rib which is positioned to extend parallel to the outer face and transverse to the edge of the bench top to receive the outer face thereagainst. Preferably, the rib is provided on the base.

Preferably, the clamping device further comprises a retainer which is configured to engage the edge piece to hold it against the first locator. Preferably, the retainer is movable to push or draw the edge piece against the first locator and releasably lockable to hold the edge piece against the first locator. Preferably, the retainer is translationally moveable in a direction parallel to the plane of the bench top and perpendicular to a longitudinal axis of the edge piece to draw the edge piece against the locating portion. The retainer may thus also be engageable with edge pieces of differing thickness. Preferably, the first locator is arranged to abut an outer face of the edge piece, and the retainer is configured to abut an inner face of the edge piece to urge the edge piece against the first locator. Preferably, the retainer is translationally moveable in a direction of projection of the edge piece from the edge. The retainer may thus also be engageable with edge pieces of differing depth. Preferably, the retainer is configured for rotational movement about an axis which is parallel to a longitudinal axis of the edge piece. In a preferred embodiment of the invention, the retainer is thus engageable with edge pieces which form different angles with the bench top and/or able to be rotated from an operating position into a stowed position, in which it is arranged in general alignment with the base.

Preferably, the retainer comprises a releasably lockable retaining member which is supported from the body and configured to extend inwardly therefrom to engage the edge piece. Preferably, the retaining member is formed with a slot and comprises a mount which is received through the slot to mount the retaining member to the body and to permit translational movement of the retaining member parallel to the plane of the bench top and perpendicular to a longitudinal axis of the edge piece to draw the edge piece against the locating portion. The retaining member may thus also be engageable with edge pieces of differing thickness. Preferably, the body is formed with a slot which is arranged to extend in the direction in which the edge piece is to project from the edge, and the mount is received through that slot to mount the retaining member to the body and to permit movement of the retaining member with respect to the body in the direction of that slot when in an unlocked condition. The retaining member may thus also be engageable with edge pieces of differing depth. Preferably, the mount is configured to permit rotation of the retaining member thereabout when in an unlocked condition. In a preferred embodiment of the invention, the retaining member is thus engageable with edge pieces which form different angles with the bench top and/or able to be rotated from an operating position into a stowed position, in which it is arranged in general alignment with the base. Preferably, the mount comprises a locking device arranged to lock the retaining member to the body. Preferably, the mount comprises a locking screw.

According to a preferred embodiment of the invention, the first clamping member is slidable axially with respect to the body between a retracted position, in which it is clear of the bench top, and an extended position in which it is receivable against the bench top to effect clamping of the device to the bench top, and the device further comprises a locking mechanism configured to lock the clamping member in its extended position ("the first clamping member locking mechanism"). Preferably, the first clamping member locking mechanism is of a quick-release type. Preferably, the first clamping member locking mechanism comprises a locking element which is movable between a released position, in which it is disengaged from the clamping member, and a locking position, in which it engages the clamping member, and further comprises a biasing means which biases the locking element into its locking position. The locking element may comprise a depressable tab member arranged to pivot between the released position and locking position.

Preferably, the first clamping member comprises a sleeve arranged for engagement with the first clamping member locking mechanism, a rod received through the sleeve, and a clamping face arranged at an end of the rod to be receivable against said other surface of the bench top, the sleeve and rod having interengaging threads permitting adjustment of the position of the rod with respect to sleeve and thus fine adjustment of the position of said end. Preferably, the first clamping member further comprises a pad member on which said clamping face is defined, the pad member being adapted to be able to swivel with respect to the rod about the axis of the clamping member. Alternatively, said clamping face may be formed on the end of the rod.

According to a preferred embodiment of the invention, the second clamping member is slidable axially with respect to the body between a retracted position, in which it is clear of the edge piece, and an extended position in which it is receivable against the edge piece to apply clamping pressure to the mitre joint, and the clamping device further comprises a locking mechanism configured to lock the second clamping member in its extended position (the "second clamping member locking mechanism"). Preferably, the second clamping member locking mechanism is of a quick-release type. Preferably, the second clamping member locking mechanism comprises a locking element which is movable between a released position, in which it is disengaged from the second clamping member, and a locking position, in which it engages the second clamping member, and further comprises a biasing means which biases that locking element into its locking position. The locking element of the second clamping member locking mechanism may comprise a depressable tab member arranged to pivot between the released position and locking position.

Preferably, the second clamping member comprises a sleeve arranged for engagement with the second clamping member locking mechanism ("the second clamping member sleeve"), a rod received through the second clamping member sleeve ("the second clamping member rod"), and a clamping face arranged at an end of the second clamping member rod to be receivable against the edge piece ("the second clamping member clamping face"), the second clamping member sleeve and second clamping member rod having interengaging threads permitting adjustment of the position of the second clamping member rod with respect to second clamping member sleeve and thus fine adjustment of the position of the second clamping member clamping face. Preferably, the second clamping member further comprises a pad member, on which the second clamping member clamping face is defined, which is adapted to swivel with respect to the second clamping member rod about a longitudinal axis of the second clamping member. Alternatively, the second clamping member clamping face may be formed on the end of the second clamping member rod.

Preferably, the device is provided with an adhesive collector which removably mounted thereto and arranged for receipt of excess adhesive from the mitre joint. Preferably, the collector is supported on the body. In a preferred embodiment of the invention, the collector is supported on the second arm adjacent the base. Preferably, the collector is receivable over the rib to be located laterally on the second arm.

According to a fourth aspect of the present invention, there is provided a method of attaching an edge piece to an edge of a bench top, the edge and edge piece being formed with mating mitres whereby a mitre joint is formed therebetween, comprising:

positioning a locator adjacent the edge; and with the edge piece retained against the locator, urging the edge piece towards the edge to effect attachment of the edge piece.

Preferably, locator is arranged such that it abuts an outer face of the edge piece, and the edge piece is urged towards the edge in a direction in which the edge piece is to project from the edge when attached thereto.

In a preferred embodiment of the invention, the method further comprises displacing the edge piece into abutment with the locator.

In a preferred embodiment of the invention, the edge piece is drawn or pushed against the locator and retained thereagainst whilst the edge piece is clamped against the edge.

BRIEF DESCRIPTION OF THE DRAWINGS

The present invention will now be described, by way of non-limiting example only, with reference to the accompanying drawings, in which.

DETAILED DESCRIPTION OF THE PREFERRED EMBODIMENTS

Figure 1:
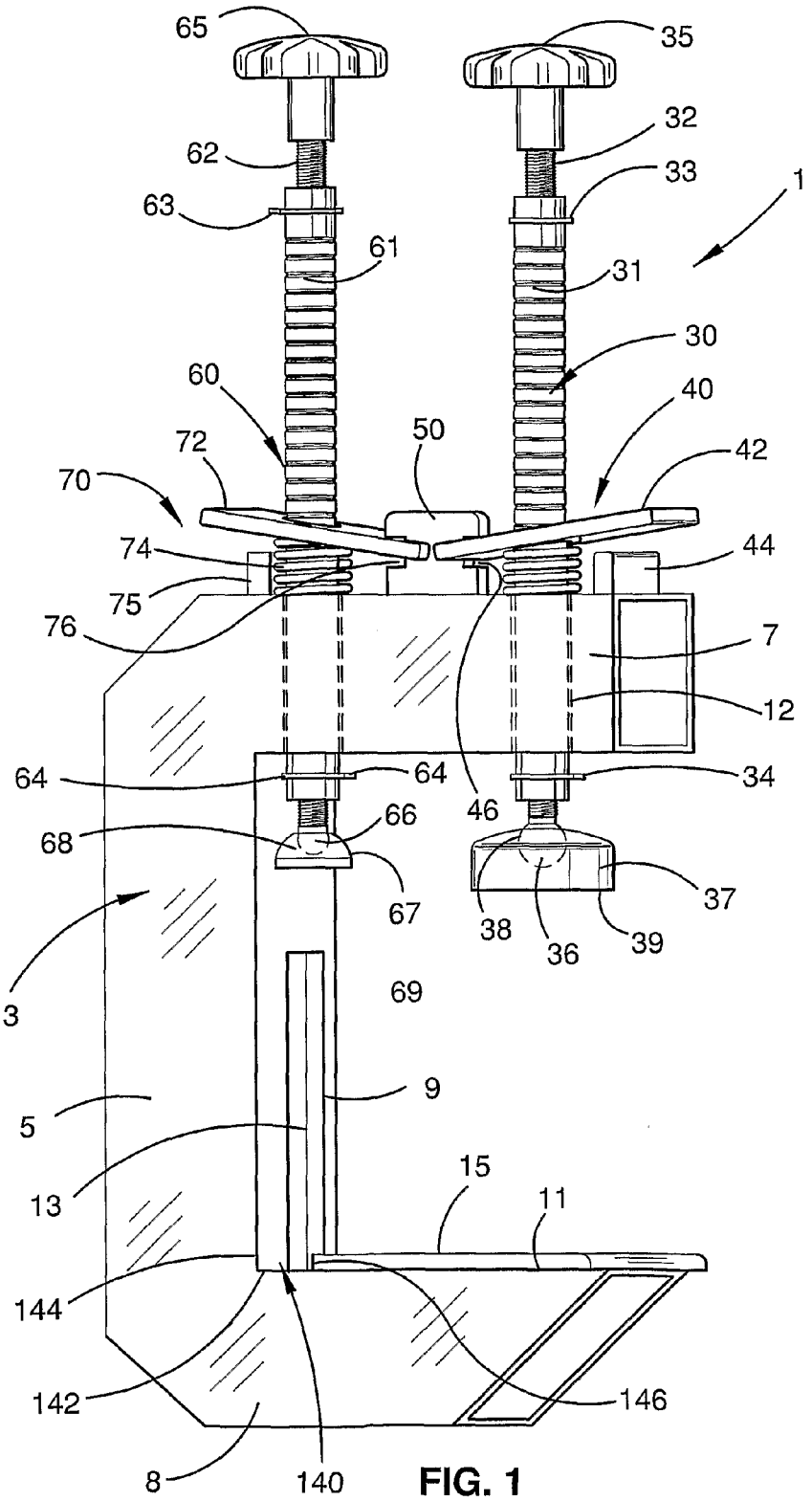
FIG. 1 is a front isometric view of a tool for attaching an edge piece a bench top according to a first embodiment of the present invention.

With reference to FIG. 1, a device for attaching an edge piece to a bench top in accordance with a preferred embodiment of the invention is configured in the form of a clamping tool 1. The tool 1 comprises a rigid, generally C-shaped frame cast from aluminium, the frame defining a base 5 and parallel upper 7 and lower 8 arms which extend from opposite ends of the base 5.

Integrally moulded with the base 5 is a locator in the form of a narrow spine or rib 9, which extends parallel to the axis of the base 5 and projects forwardly from an inner face of the base 5, against which an outer face of the edge piece is to be received, as will be described in detail later. In the present embodiment, the rib 9 has a rectangular transverse cross-section, and thus a flat front surface 13 which is arranged to abut the outer face. In another embodiment, the rib 9 instead converges forwardly to an edge arranged to abut the outer face.

The lower arm 8 is configured with a flange 11 having a flat upper surface 15 which is arranged for receipt against the bench top. The flange 11 comprises a plate-like formation, which forms part of the moulding and has a flat upper face which may define the upper surface 15 or which may receive a thin covering sheet of rubber of uniform thickness which defines the upper surface 15 and protects the bench top from damage.

The rib 9 and flange 11 are positioned precisely so that the surfaces 13 and 15 are arranged at the same angle as that which the outer face of the edge piece is to form with the surface of the bench top, thus defining locators whereby the tool 1 can be used to locate precisely the edge piece against the bench top, as will be described in further detail later. In the present embodiment, that angle is 90 degrees, and the surfaces 13 and 15 are thus perpendicular to each other. In other embodiments, however, that angle may be acute or obtuse.

The tool 1 further comprises an elongate first clamping member 30 and an elongate second clamping member 60, both clamping members 30, 60 being received through apertures 12 extending through the upper arm 7 to be movable with respect to the upper arm 7. Clamping member 30 is arranged to engage the bench top and clamping member 60 is arranged to engage the edge piece, as will be described in further detail later.

Clamping member 30 comprises a sleeve 31, which is open at both ends, and a threaded rod 32 received through the sleeve 31. The inner wall of the sleeve 31 is formed with a thread (not shown), at least at one or both of its upper and lower ends, whereby the rod 32 threadingly engages the sleeve 31. The clamping member 30 further comprises a handle 35, which is fixed to the upper end of the rod 32, and a pad member 37, which is attached to the lower end of the rod 32. Formed at the lower end of the rod 32 is a ball 36, which is received in a correspondingly shaped socket 38 formed in the pad member 37, whereby there is formed a ball-and-socket connection between the rod 32 and pad 37, the connection allowing relative rotation or swivelling between the pad 37 and rod 32, and thus preventing rotation of the pad member 37 whilst it engages the bench top during downward screwing of the rod 32. The connection also permits a degree of rotation of the pad member 37 about any axis transverse to the axis of rod 32 so that a clamping face 39 of the pad member 37 will be arranged true when engaging the bench top.

The tool 1 comprises a positioning mechanism 40, which is of a "quick-release" type and provides for rapid lowering of the clamping member 30 for clamping the tool 1 against the bench top (to mount it), and also for rapid raising of the clamping member 30 for removal of the tool 1 from the bench top ("the first positioning mechanism"). The first positioning mechanism 40 comprises a tab member 42 which is formed with a hole therethrough whereby the tab 42 is received over the sleeve 31. The hole in the tab 42 is elongated slightly in the direction parallel to the axis of arm 7, whereby the tab 42 can assume the inclined position, shown in FIG. 1, in which it engages the sleeve 31 to lock the sleeve 31, and thus the clamping member 30, in position ("the locking position"). The mechanism 40 further comprises a compression spring 44 which is arranged between the tab member 42 and arm 7 and biases the tab member 42 in the locking position. The tab member 42 is anchored to the arm 7 by an upright lug 50, which is fixed to the upper face of arm 7 and which is formed with a notch 46, into which a proximal end of the tab member 42 is received. The proximal end of the tab member 42 is also formed with a notch, into which an edge of the lug 50 is received, whereby the lug 50 and proximal end of the tab member 42 engage each other in overlapping relation and the latter is retained by the former. The position where the tab member 42 and plate 50 engage serves as a pivot point, about which the tab member 42 will pivot when a force is applied to or removed from its distal end. The outer wall of sleeve 31 is formed with several spaced apart circumferentially extending grooves 43 into which the circumferential edge of the tab member 42 defining the hole through that member is receivable to lock the sleeve 31 to the tab member 42. In particular, a proximal portion 45A and/or a distal portion 45B of the circumferential edge may be received by the grooves 43. Advantageously, the greater the clamping force exerted by the clamping member 30 against the bench top, the greater the upward force exerted by that member against the tab member 42 and thus, owing to the pivotal connection the tab member 42 and plate 50, the tighter the engagement of the edge portion(s) with the groove(s) 43.

An alternative embodiment is possible in which the grooves 43 are omitted and the circumferential edge of the hole simply engages the outer surface of the sleeve 31 and bites against that surface under the upward force exerted on the tab member 42 by the clamping member 30.

Retainingly received into corresponding grooves at upper and lower ends of the sleeve 31 are circlips 33 and 34 respectively, which prevent those ends from being pushed through the tab 42 and drawn through the arm 7 respectively.

The mechanism 40 further comprises a stopper 44 in the form of an upright plate fixed to the upper face of upper arm 7 and positioned below the distal end of the tab member 42 to limit the downward displacement of that end.

Clamping member 60 is configured essentially the same way as clamping member 30, comprising a sleeve 61 which is open at both ends, and a threaded rod 62 received through the sleeve 61. The inner wall of the sleeve 61 is formed with a thread (not shown), at least at its upper and lower ends whereby the rod 62 threadingly engages the sleeve 61. The clamping member 60 further comprises a handle 65, which is fixed to the upper end of the rod 62, and a pad member 67, which is attached to the lower end of the rod 62. Formed at the lower end of the rod 62 is a ball 66, which is received in a correspondingly shaped socket 68 formed in the pad member 67, whereby there is formed a ball-and-socket connection between the rod 62 and pad 67, the connection allowing relative rotation or swivelling between the pad 67 and rod 62, and thus preventing rotation of the pad member 67 whilst it engages the edge piece during downward screwing of the rod 62. The connection also permits a degree of rotation of the pad member 67 about any axis transverse to the axis of rod 62 so that a clamping face 69 of the pad member 67 will be arranged true when engaging the edge piece.

The tool 1 comprises a further positioning mechanism 70, which is of a "quick-release" type and provides for rapid lowering of the clamping member 60 for clamping the edge piece against the bench top, and also for rapid raising of the clamping member 60 to disengage it from the edge piece. The mechanism 70 comprises a tab member 72 which is formed with a hole therethrough whereby the tab 72 is received over the sleeve 61. The hole in the tab 72 is elongated slightly in the direction parallel to the axis of arm 7, whereby the tab 72 can assume the inclined position, shown in FIG. 1, in which it engages the sleeve 61 to lock the sleeve 61, and thus the clamping member 60, in position ("the locking position"). The mechanism 70 further comprises a compression spring 74 which is arranged between the tab member 72 and arm 7 and biases the tab member 72 in the locking position. The tab member 72 is anchored to the arm 7 by an upright lug 50, which is fixed to the upper face of arm 7 and which is formed with a notch 76, into which a proximal end of the tab member 72 is received. The proximal end of the tab member 72 is also formed with a notch, into which an edge of the lug 50 is received, whereby the lug 50 and proximal end of the tab member 72 engage each other in overlapping relation and the latter is retained by the former. The position where the tab member 72 and plate 50 engage serves as a pivot point, about which the tab member 72 will pivot when a force is applied to or removed from its distal end. The outer wall of sleeve 61 is formed with several spaced apart circumferentially extending grooves 73 into which the circumferential edge of the tab member 72 defining the hole through that member is receivable to lock the sleeve 61 to the tab member 72. In particular, a proximal portion 75A and/or a distal portion 75B of the circumferential edge may be received by the grooves 73. Advantageously, the greater the clamping force exerted by the clamping member 60 against the bench top, the greater the upward force exerted by that member against the tab member 72 and thus, owing to the pivotal connection the tab member 72 and plate 50, the tighter the engagement of the edge portion(s) with the groove(s) 73.

An alternative embodiment is possible in which the grooves 73 are omitted and the circumferential edge of the hole simply engages the outer surface of the sleeve 61 and bites against that surface under the upward force exerted on the tab member 72 by the clamping member 60.

Retainingly received into corresponding grooves at upper and lower ends of the sleeve 61 are circlips 66 and 64 respectively, which prevent those ends from being pushed through the tab 72 and drawn through the arm 7 respectively.

The mechanism 70 further comprises a stopper 74 in the form of an upright plate fixed to the upper face of upper arm 7 and positioned below the distal end of the tab member 72 to limit the downward displacement of that end.

The operation of the tool 1 to attach an edge piece to a bench top will now be described with reference to the drawings.

Figure 2:
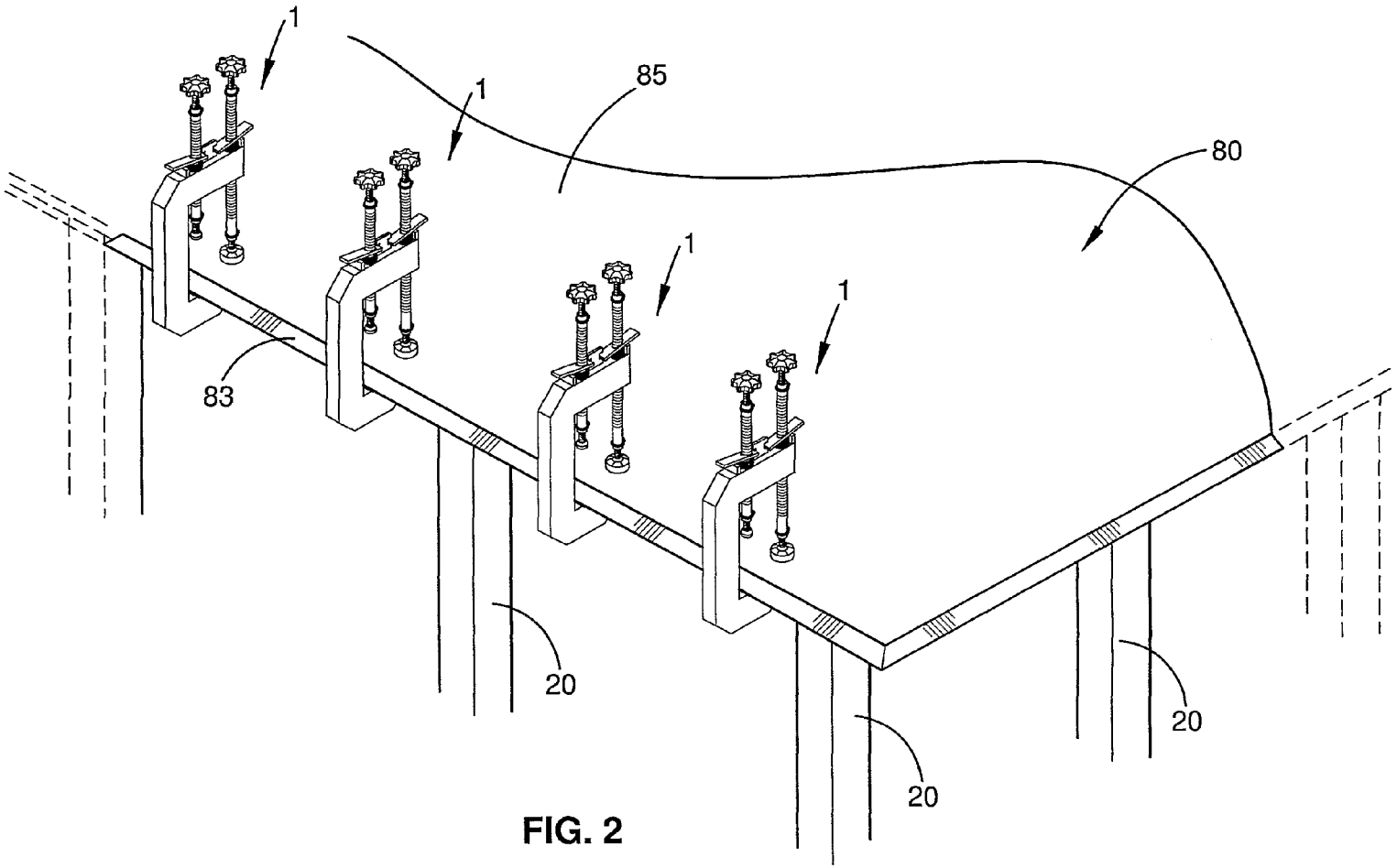
FIG. 2 is a perspective view showing several tools according to the first embodiment arranged along a bench top edge.
Figure 3:
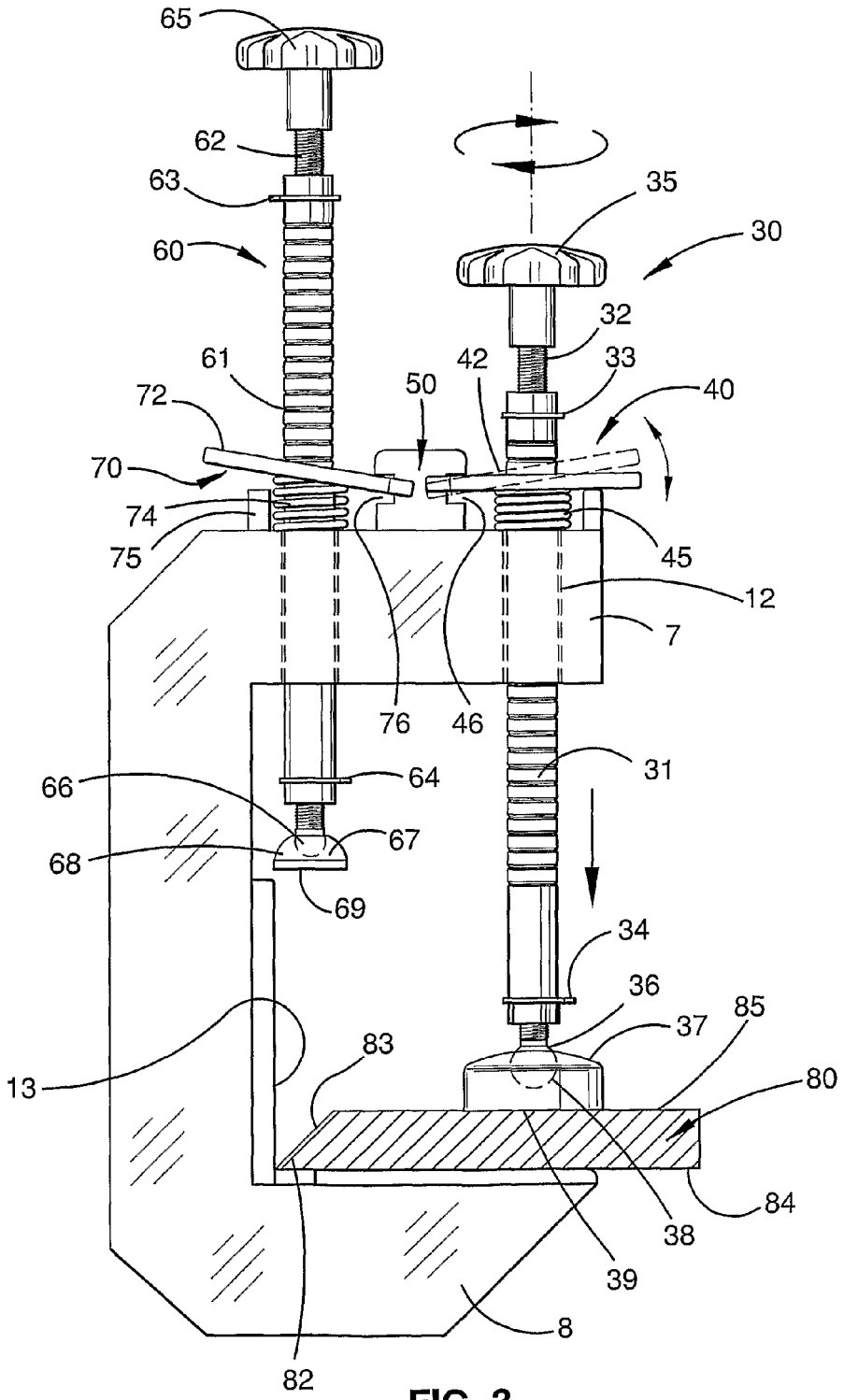
FIG. 3 is a side elevation view showing the tool of the first embodiment mounted to the bench top.

With reference firstly to FIG. 2, a rigid sheet which forms the bench top 80 is arranged level on suitable support members 20, the underside of the sheet so arranged forming the top surface 84 of the bench top. The edge 82 of the bench top 80 is already preformed with a mitre, which in the present embodiment is a 45°, as can be seen in FIG. 3, the inclined face 83 of which is uppermost. Tools 1 according to the preferred embodiment are then mounted to sheet 80 adjacent the edge 82, spaced apart by appropriate intervals.

Mounting of each tool 1 is a simple and rapid procedure. Specifically, with reference to FIG. 3, with the tool 1 arranged so the arms 7 and 8 extend perpendicular to the edge 82 and the outer tip of the edge 82 abuts face 13, the clamping surface 15 of arm 8 is held flat against the inverted top surface 84, the tab member 42 of the clamping member 30 depressed, and the sleeve 31 (and thus the clamping member 30 in its entirety) lowered towards the uppermost surface 85 of the bench top 80 to position the pad member 37 close to that surface. The tab member 42 is then released to lock the sleeve 31 in position. Next, the handle 35 is rotated to advance the clamping surface 39 of pad member 37 into abutment with the surface 85, whereupon the bench top 80 becomes clamped between the arm 8 and the clamping member 30. Because the ball-and-socket connection between the pad member 37 and rod 32 functions as a swivel connection, the pad member 37 will not rotate on surface 85 during downward screwing of the rod 32, whereby the surface 83 is protected from being scratched.

Figure 4:
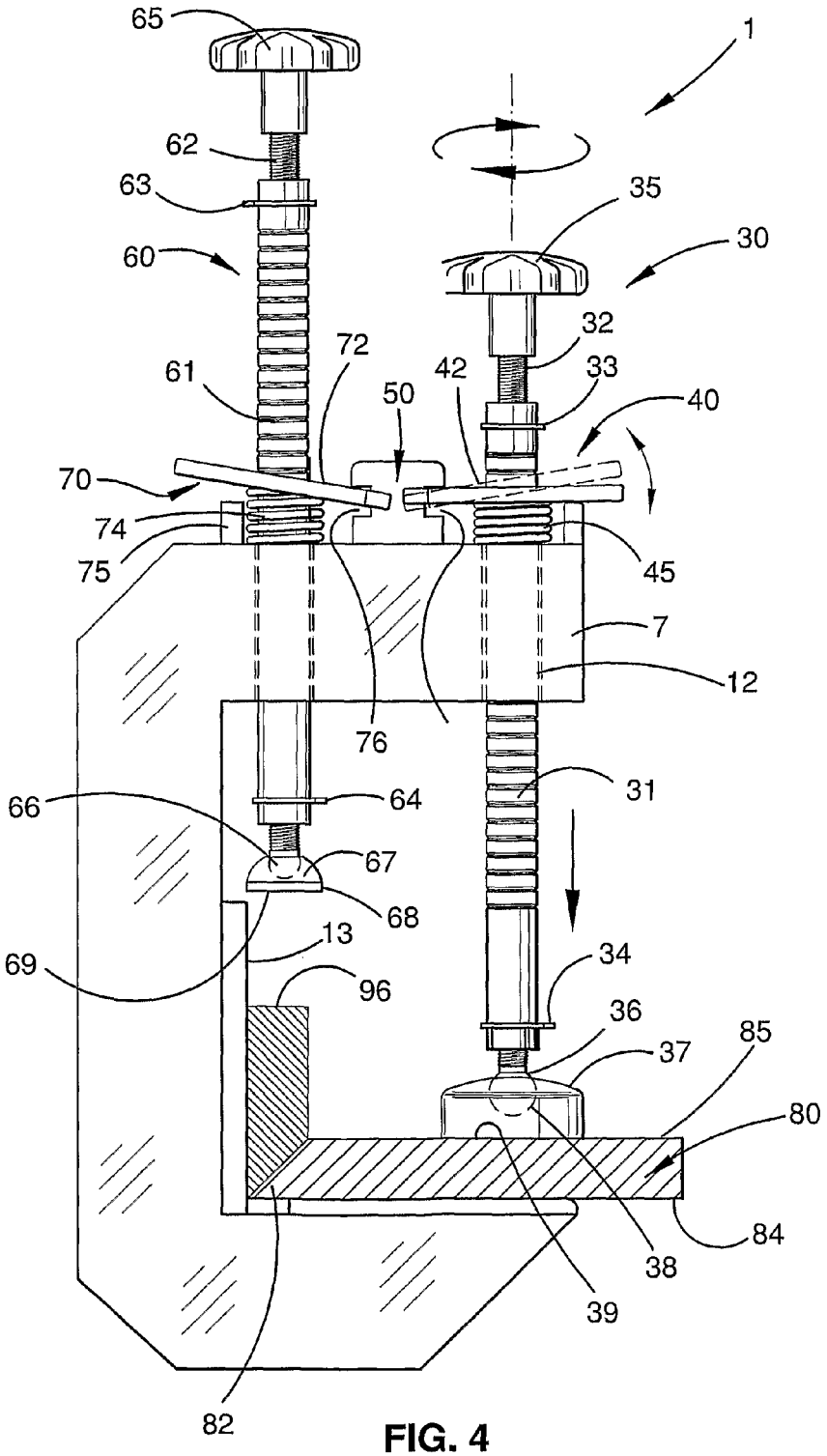
FIG. 4 is a side elevation view showing the tool of the first embodiment supporting an edge piece against an edge of the bench top.

Next, referring to FIG. 4, with the clamping members 60 of the mounted tools 1 raised, the edge piece 90, preformed with a 45° mitre, is fed from one end of the lined up tools 1, through each space defined by the lower arm 8, base member 5, upper arm 7 and clamping member 30 of each tool 1, and positioned upright such that the inclined face 92 of the mitre is received against the face 83, and the outer face 94 of the edge piece is thus generally perpendicular to the plane of the bench top 80. As a result of the thickness of the adhesive between the edge piece 90 and edge 82, and/or if the edge piece 90 is bowed or warped inwardly at any position, the outer face 94 may be spaced from the surface 13 of at least one of the tools 1 adjacent that position, whereby the edge piece 90 will sit too high on face 83. Conveniently, the/each such tool 1 can displaced outwardly slightly by tapping one of the side faces of its base member 5 with a hammer, thereby displacing the surface 13 outwardly, causing the edge piece 90 to slide down face 83 towards its true position, so completing a pre-alignment stage. Advantageously, because the rib 9 is narrow, the position of the surface 13 can be adjusted, by very small amounts, when the side of the base member 5 is tapped, without any resultant fouling of another part of the rib 9 against the edge piece 90, which may cause misalignment.

Figure 5:
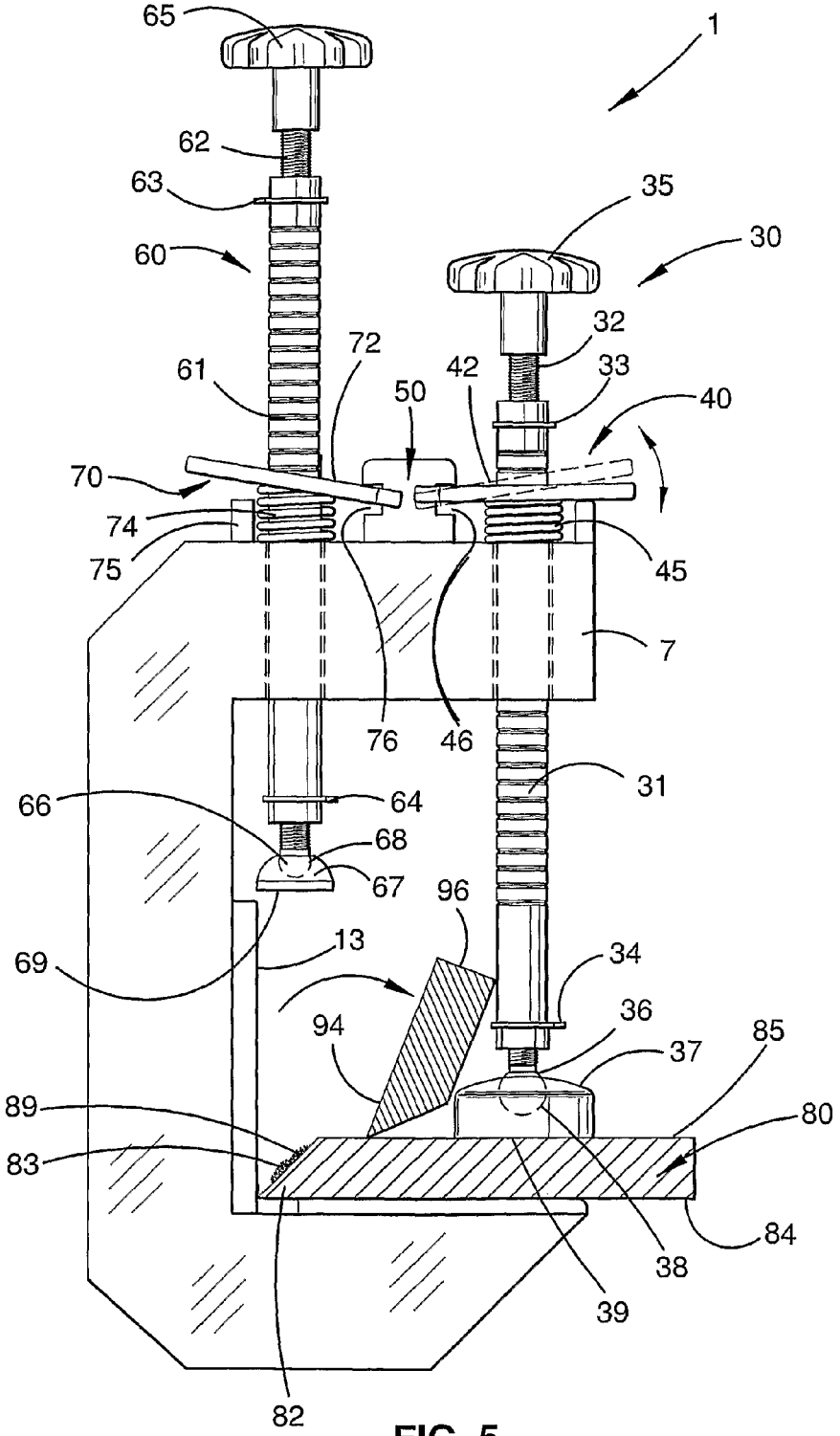
FIG. 5 is a side elevation view of the arrangement shown in FIG. 4, in which the edge piece has been laid on its side against the bench top and adhesive has been applied to the bench top edge.

Following pre-alignment, with reference to FIG. 5, the edge piece 90 is lifted onto the surface 85 and leaned over to rest against clamping member 30, thereby exposing face 83, to which adhesive 89 is then applied. The edge piece 90 is then re-orientated in its upright position such that the adhesive 89 is sandwiched between the faces 92 and 83.

Figure 6:
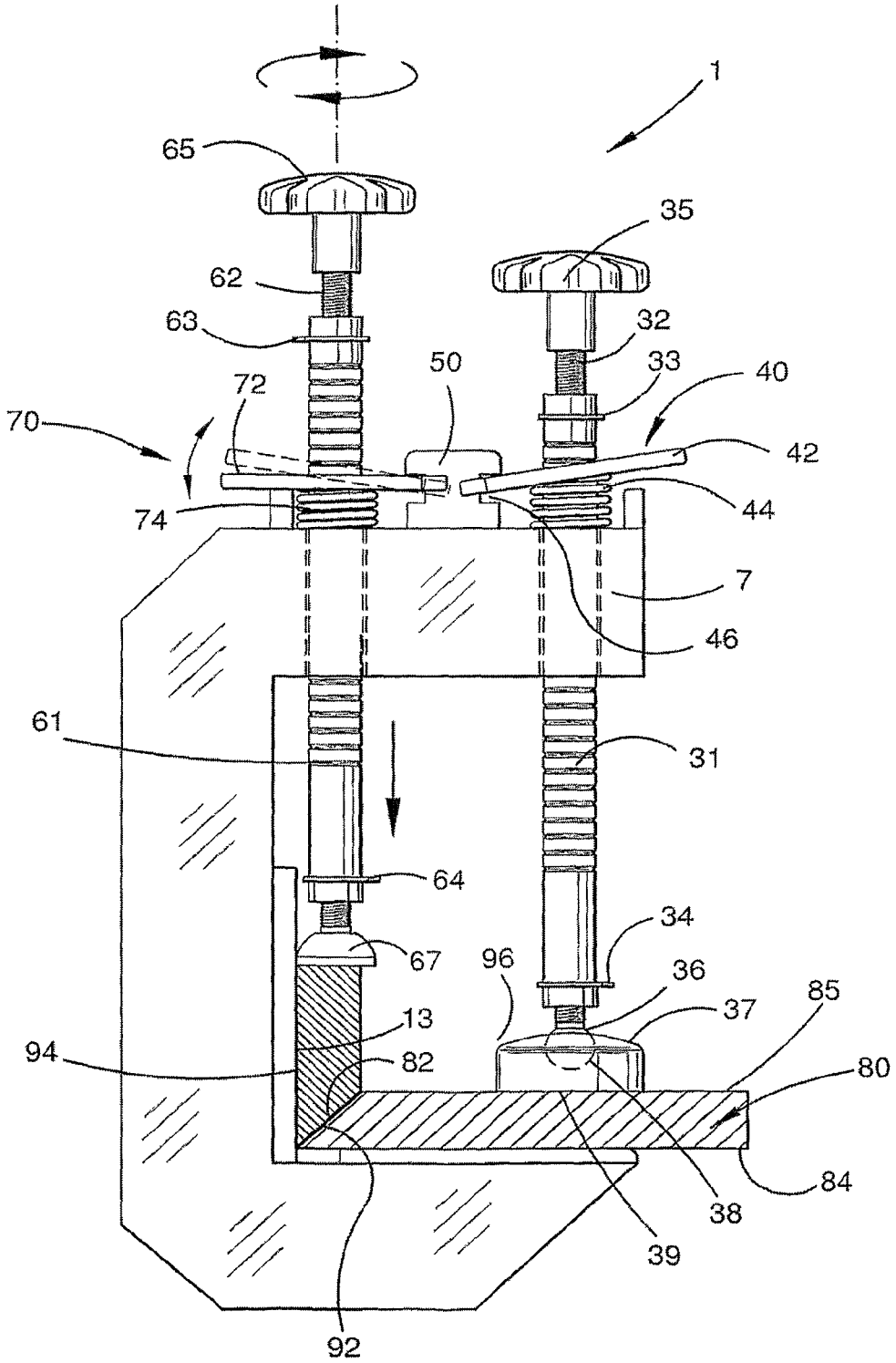
FIG. 6 is a side elevation view of the arrangement shown in FIG. 5, in which the edge piece has been repositioned against the bench top edge and is being clamped by the tool of the first embodiment.
Figure 7:
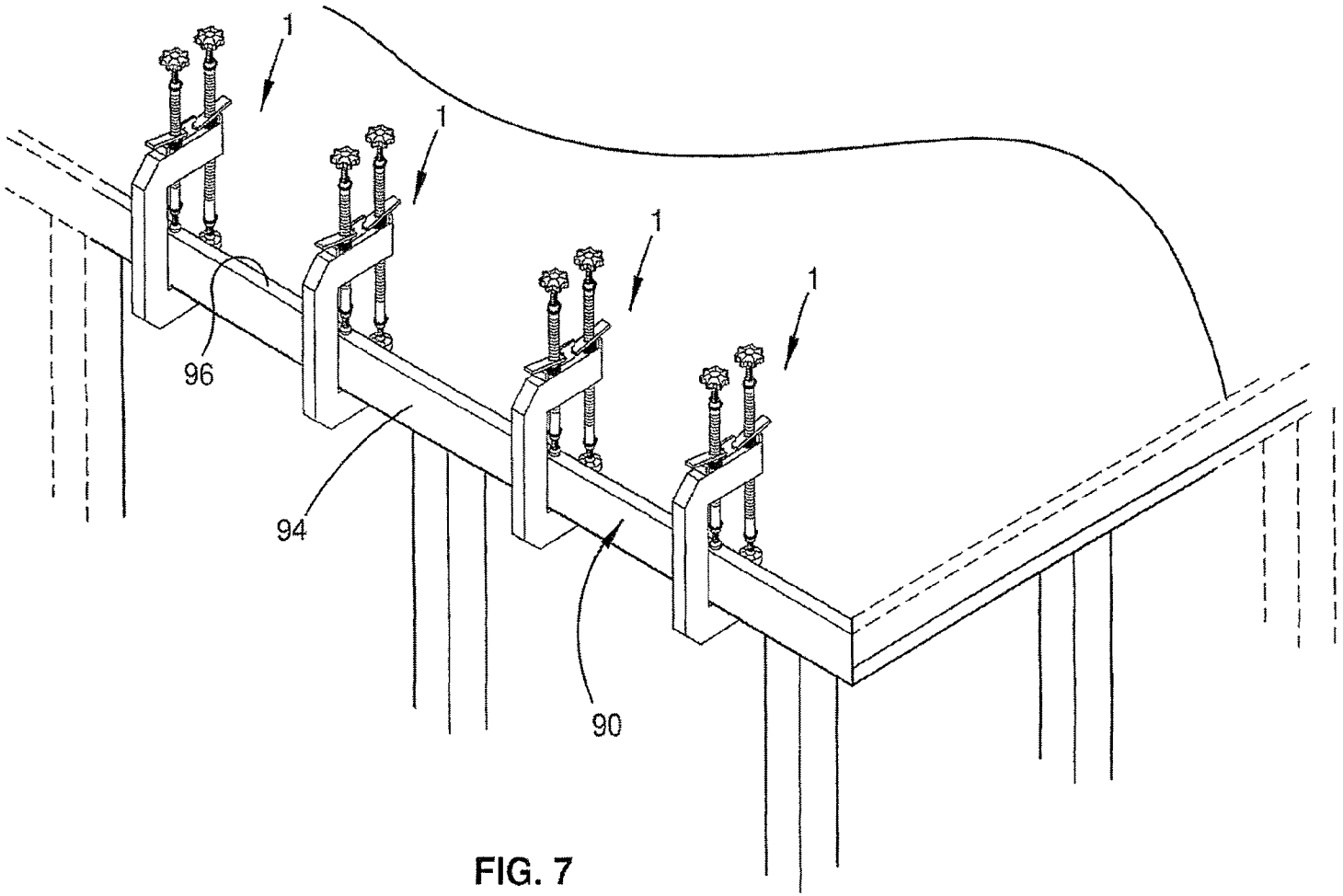
FIG. 7 is a perspective view of the edge piece being clamped against the bench top edge by the tools of the first embodiment.

With reference to FIGS. 6 and 7, when the edge piece 90 is correctly aligned at the position of each tool 1 along the edge portion of the bench top 80 (albeit perhaps vertically offset a little due to the thickness of the adhesive 89), the second clamping member 60 of each tool is lowered to compress the edge piece 90 against the edge 82. Specifically, the tab member 72 is depressed to enable the member 60 to be rapidly lowered so that pad member 67 is positioned closely adjacent the upper face 96 of edge piece 90, then released to lock the sleeve 61 in position, then the handle 65 is rotated to bring the clamping face 69 into abutment with upper face 96 and so compress the faces 83 and 92 together, whereupon face 92 will slide down face 83 to bring outer face 94 against each surface 13 (in the event that there any space between outer face 94 and edge 13 has formed). Again, owing to the nature of the ball-and-joint/swivel connection between the threaded rod 62 and the pad member 67, the clamping surface 69 will be received true against surface 96, and will not rotate on that surface during downward screwing of the rod 62.

Figure 8:
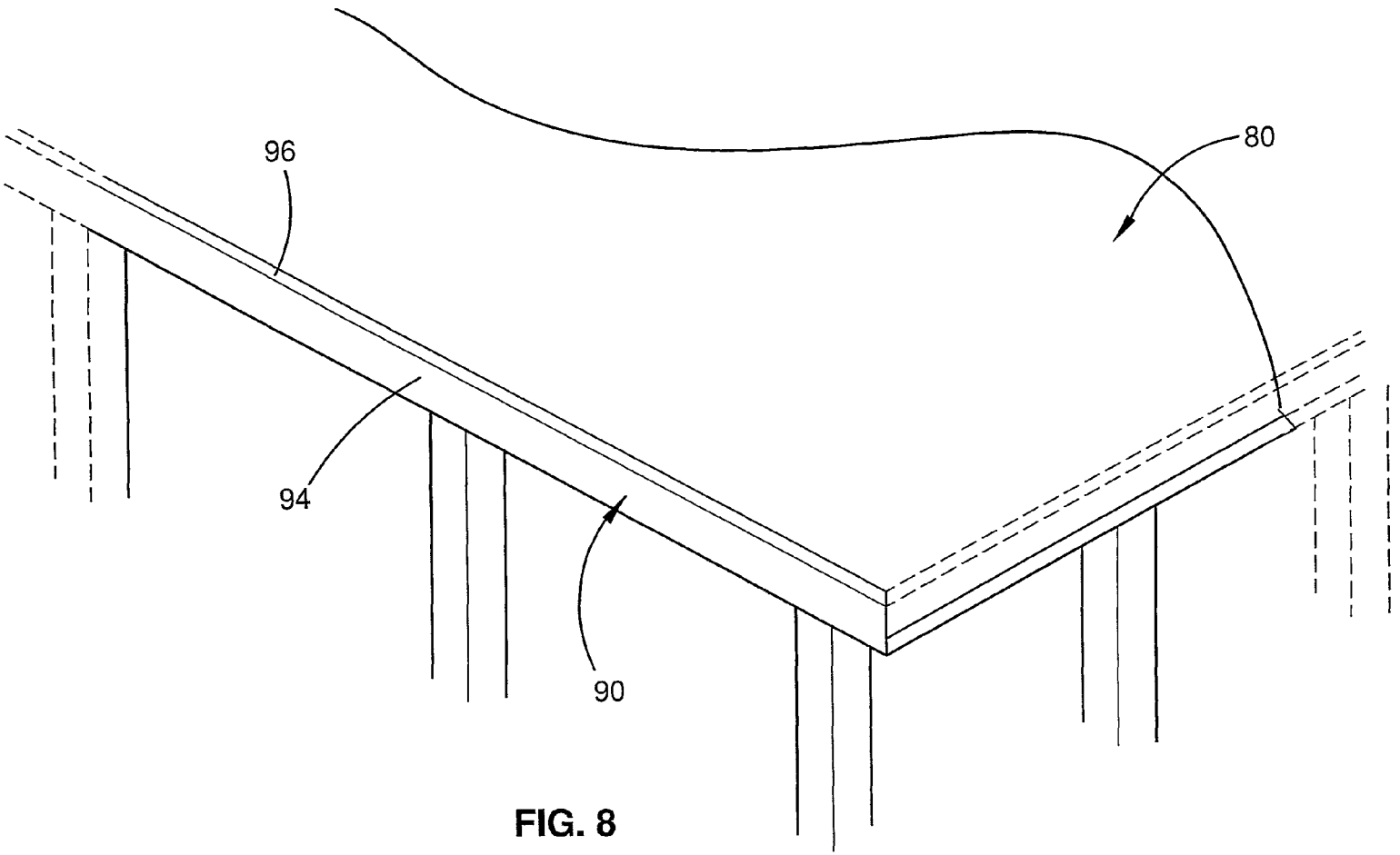
FIG. 8 is a perspective view of the edge piece and bench top adjoined.
Figure 9:
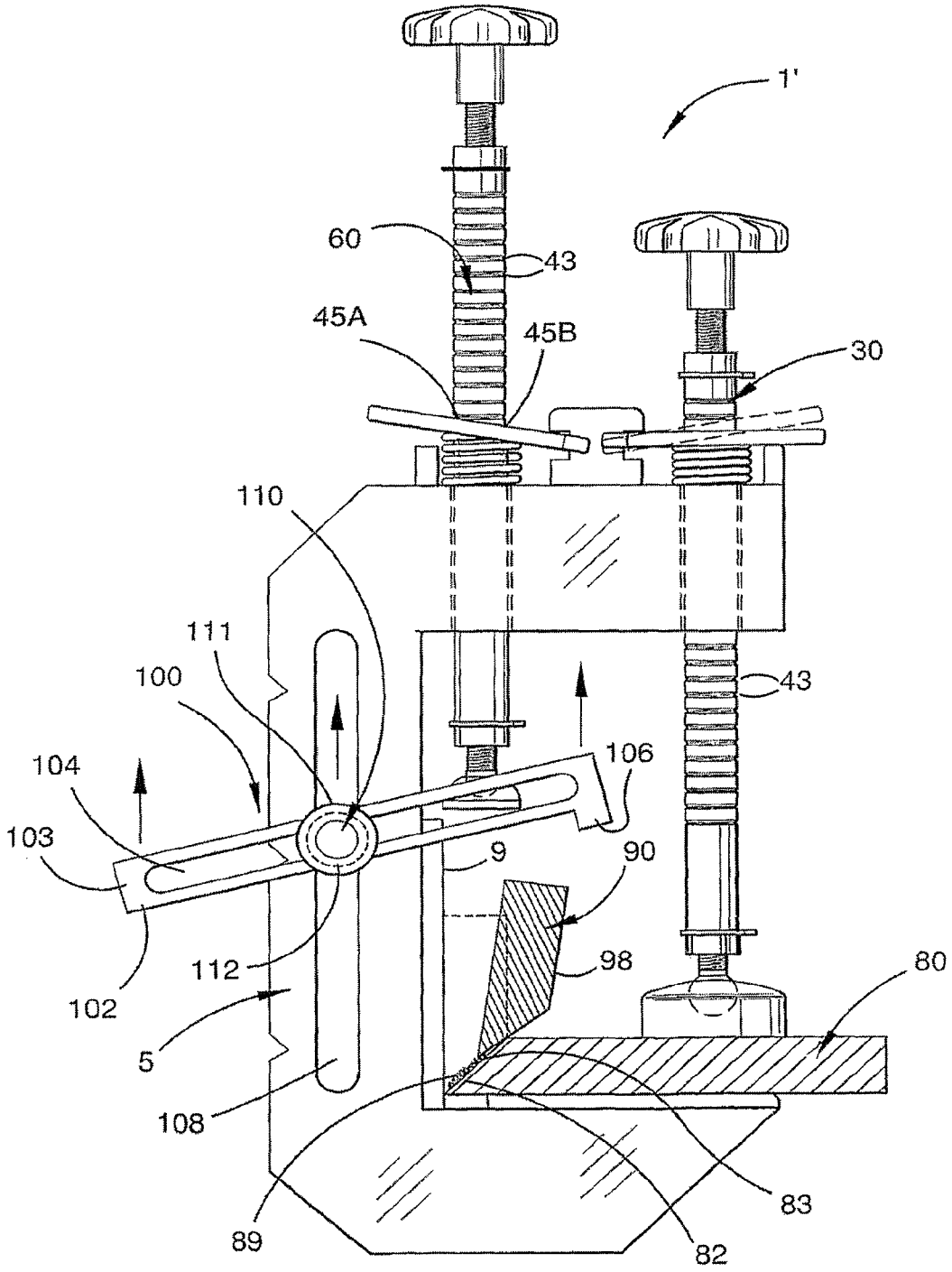
FIG. 9 is a side elevation view of a clamp for attaching an edge piece to a bench top according to a second embodiment of the present invention.

The procedure described above is carried out for each respective edge/edge piece pair of the bench top 80. Following setting of the adhesive, depression of the tab members 42 and 72 of each tool 1 permits rapid retraction of the associated clamping members 30 and 60 to release the tools 1 from the thusly attached edge(s) and edge piece(s). Attention is drawn is this regard to FIG. 8, which shows the (first) edge piece 90 thus attached to the (first) edge 81.

With reference to FIGS. 9 to 12, a clamping tool 1' according to a second preferred embodiment of the invention will now be described, with the use of the same reference numerals as used for the first embodiment to refer to the same features as in the first embodiment.

The clamp 1' is identical to the clamp 1 though further comprises a retaining mechanism 100 which is operable to engage the edge piece 90 and urge it against the rib 9 such that it is correctly located.

The retaining mechanism 100 includes a retainer 102 comprising an elongate retaining member 103 configured with a slot 104 therethrough which extends along its length, and a lip or lug 106 formed at an inner end thereof which is received over the inner top edge of the edge piece 90 to engage the inner face 98 of the edge piece 90. The mechanism 100 further includes a further slot 108, which is provided through base member 5 and extends along its length axis. The retainer 102 further comprises a locking screw 110 comprising a screw head 111, a shank which is integral with the head 111 and extends through the slots 104 and 108, and a nut 112 received on the free end of the shank. The head 111 and nut 112 are of a sufficiently large diameter to be engageable with the laterally outer walls of the retainer 102 and base 5 respectively, to retain the locking screw 110 and to lock the retainer 102 against the base 5 when the locking screw 110 is tightened. The configuration of the retaining mechanism 100 is such that the retainer 102 has two translational degrees of freedom and one rotational degrees of freedom, whereby it can be manipulated to engage edge pieces having differing dimensions and degrees of misalignment.

Operation of the clamp 1' will now be described with reference to FIGS. 9 to 12.

Firstly, the clamp 1' is mounted to the bench top 80 in exactly the same manner as described for the first embodiment. The clamp 1' is positioned such that the rib 9 abuts the edge 82.

Figure 10:
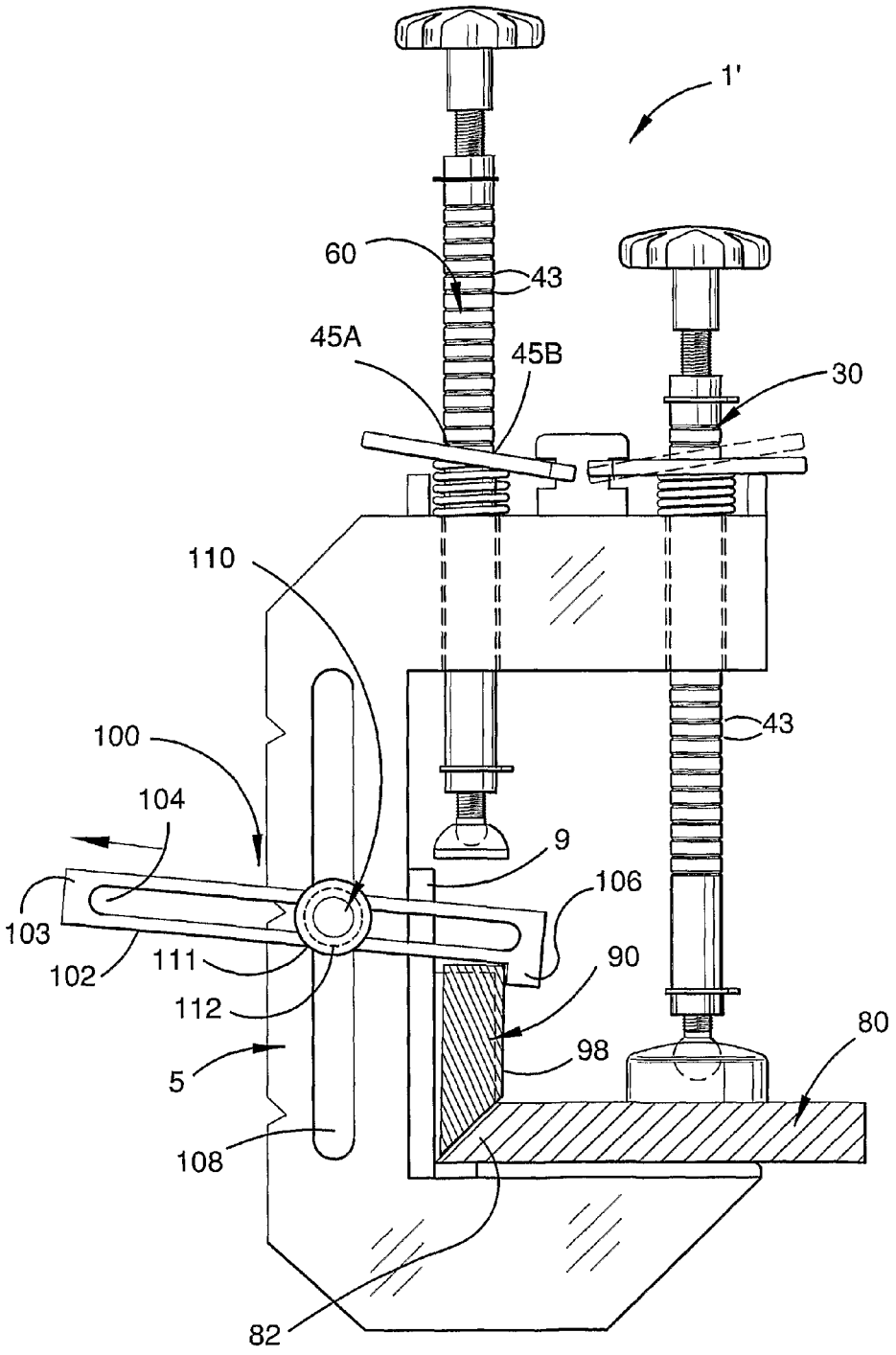
FIG. 10 is a side elevation view showing a retaining member of the tool of the second embodiment being brought into engagement with the edge piece.
Figure 11:
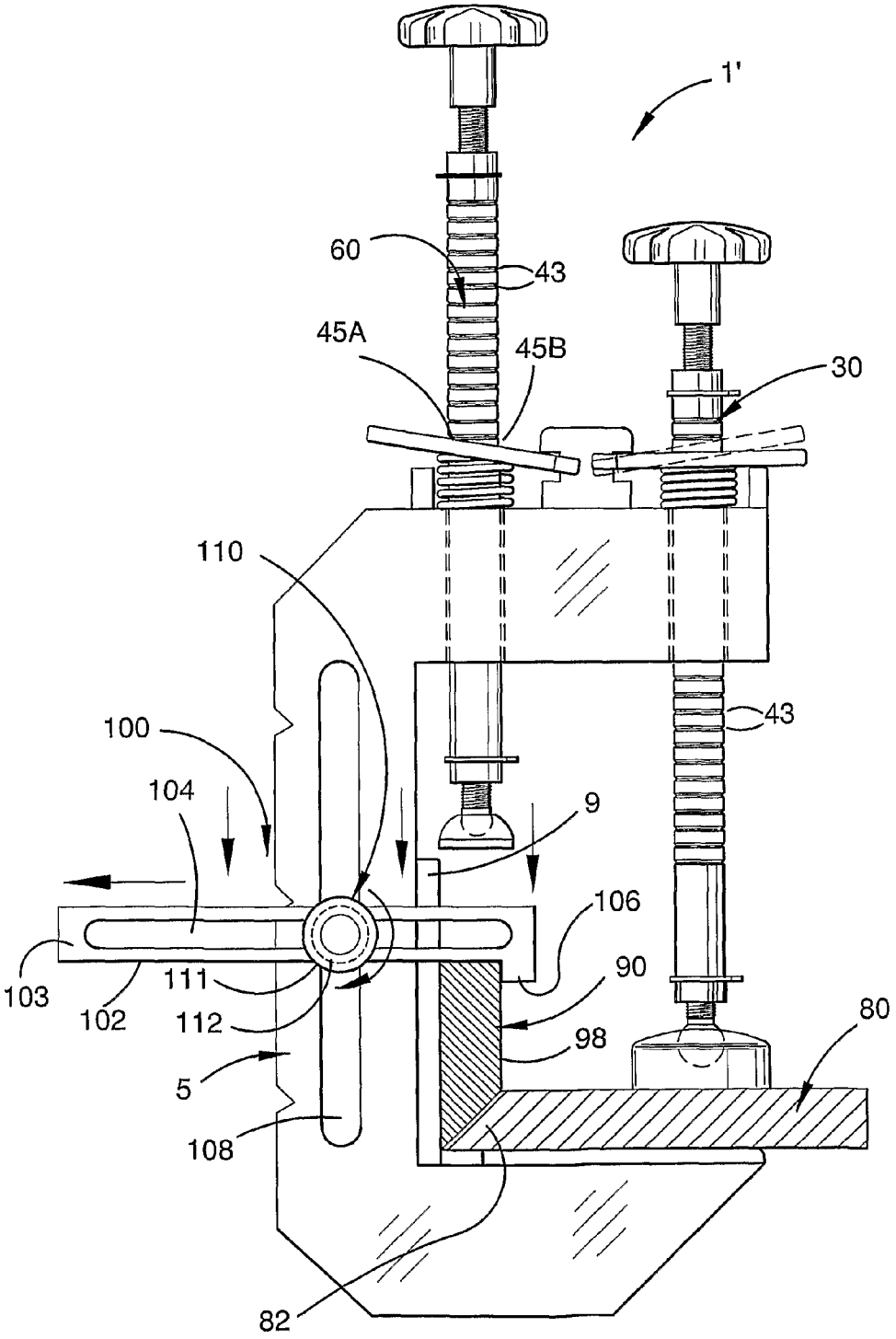
FIG. 11 is a side elevation view showing the edge piece being held in position against the clamp of the second embodiment by the retaining member.
Figure 12:
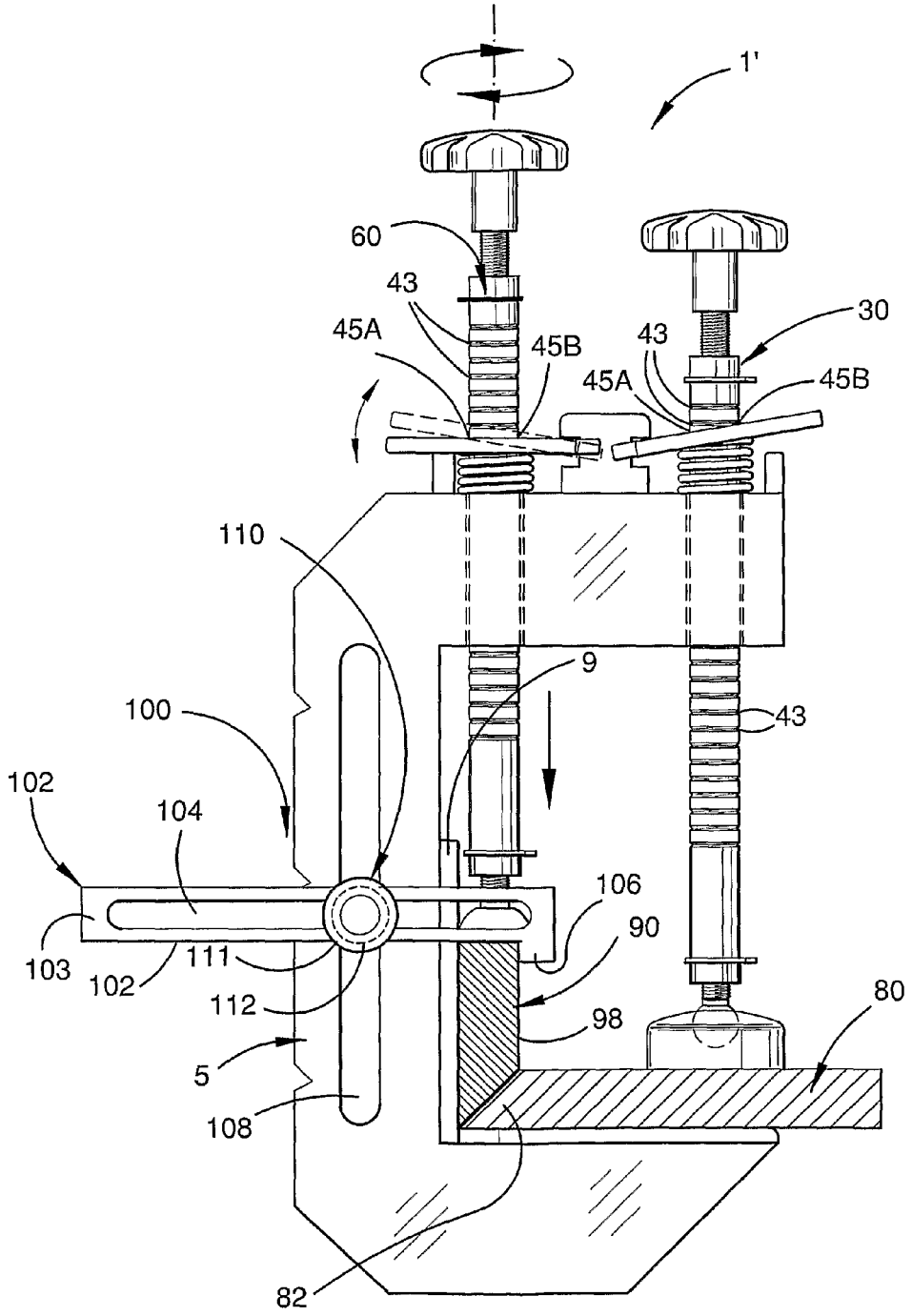
FIG. 12 is a side elevation view showing the edge piece being clamped against the bench top edge whilst being retained by the retaining member.
Figure 14:
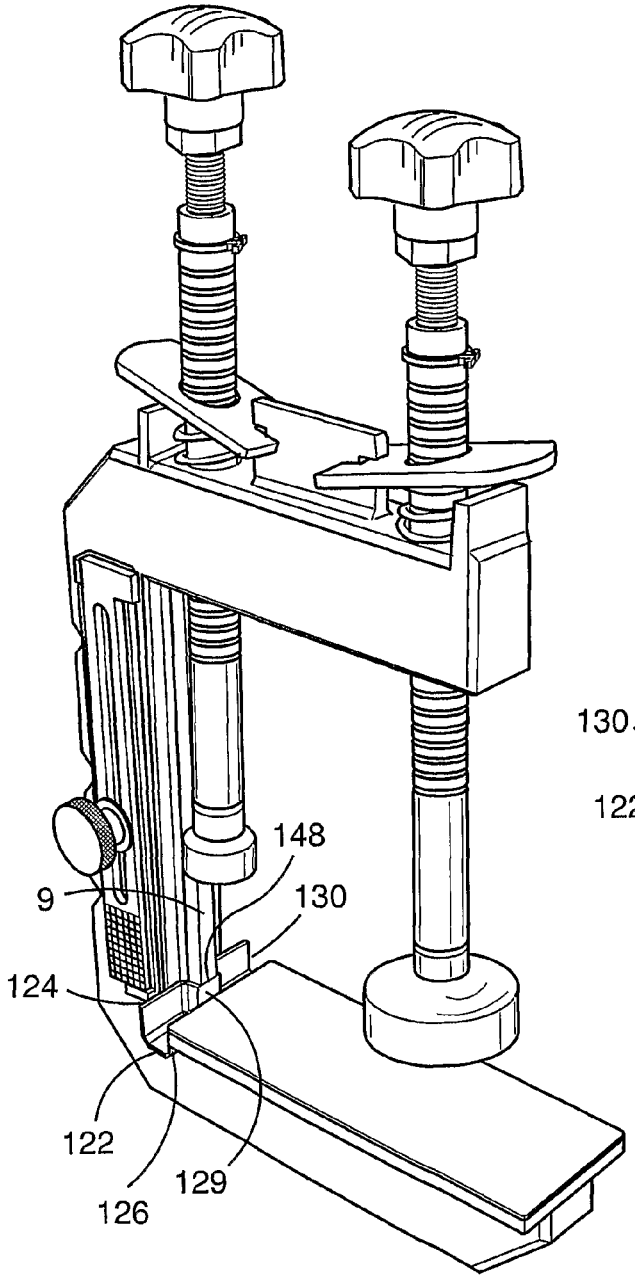
FIG. 14 is a perspective view of the clamp of second embodiment (modified slightly) with the tray mounted to it.
Figure 13:
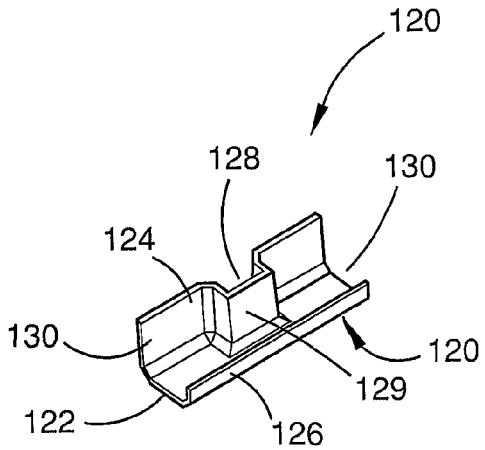
FIG. 13 is a perspective view of a adhesive collecting tray with which the clamp of either of the first and second embodiments (with slight modification) may be provided.
Figure 15:
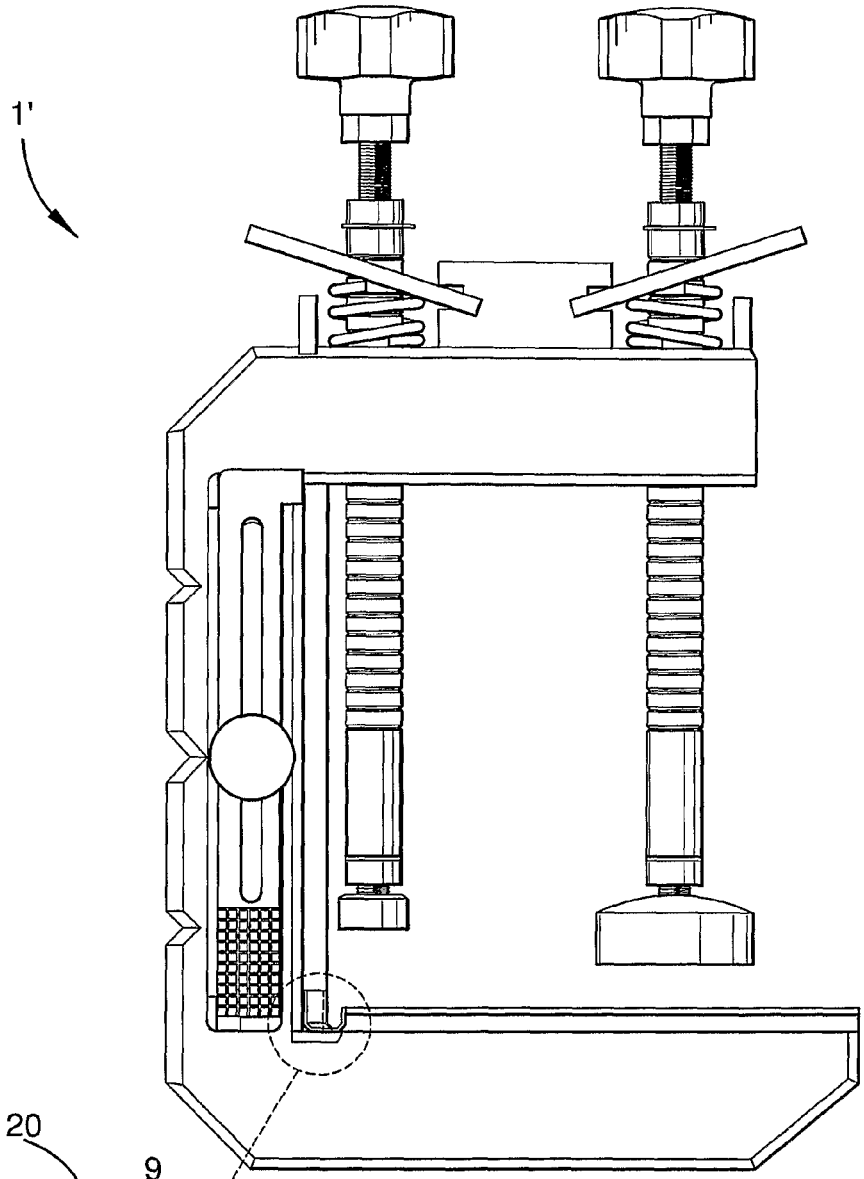
FIG. 15 is a side view of the arrangement shown in FIG. 14.
Figure 16:
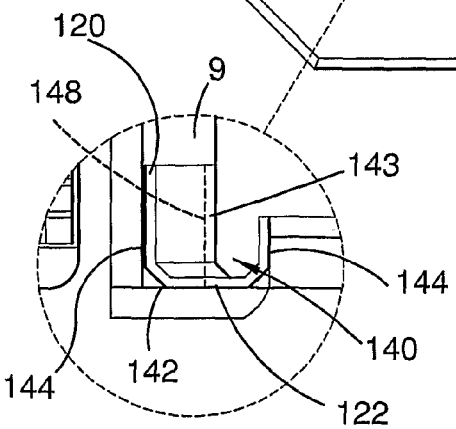
FIG. 16 is detailed side view of the tray mounted to the clamp as shown in FIG. 15.

After the appropriate number of clamps 1' have been appropriately positioned along the bench top edge 82, with the clamping members 60 and retainers 102 raised, the edge piece 90 is arranged upright on the edge 82, with adhesive 83 applied to surface 92. The edge piece 90 may have a tendency to lean and/or seat inward of its correct position, at least some of the clamps 1', as illustrated in FIG. 10. The retaining mechanism 100 is operated to draw the edge piece 90 into its correct orientation and to retain it in that orientation. Specifically, with the locking screw 110 loosened, the outer end of the retainer 102 is grasped and moved to bring the lug 106 against the inner face 98 of the edge piece 90, whereby the retainer 102 "hooks" the edge piece 90. The retainer 102 is then drawn outwardly to pull the edge piece 90 against the rib 9, such that face 94 abuts rib 9 throughout its depth and the edge piece 90 is thus aligned. The locking screw 110 is then tightened so that the retainer 102 is frictionally locked against the base 5 (see FIG. 11).

Next, clamping member 60 is operated to clamp the edge piece 90 against the edge 82, in the same manner as described in the first embodiment.

The clamps 1 and 1' may, advantageously, be provided with a removably mountable adhesive collector or tray 120, into which adhesive, which is forced from between the edge piece 90 and edge 82 when clamped together, may drain. The collector 120 comprises a flat base 122 and opposed outer 124 and inner 126 side walls. The collector 120 is configured to seat in a recess 140 defined between plate 15 and base 3. The base 122 is located against a recessed upper surface 142 of arm 8, such that outer wall 124 is received against inner face 144 of the base member 5 and inner wall 126 is received against an upright inner end face 146 of flange 11. The wall 126 is of such a height that it does not project above surface 15. More particularly, the wall 126 is arranged such that its upper edge is flush with surface 15. The wall 124 extends higher from the base 122 than does wall 126, and is formed at an intermediate position therealong with an upright channel 128 which opens outwardly and is open at each end to be received over the lower end of rib 13, whereby it seats against the rib 9 to locate the collector 120 laterally.

When the edge piece 90 and edge 82 are forced together, adhesive thus oozing from the interface between them drains into the tray instead of running onto the clamp 1/1'. After the clamp is removed from the bench top, the collector 120 is lifted out of recess 140 and either discarded, to be replaced with a fresh, like, collector, or cleaned for re-use.

The collector 120, is, in the present embodiment(s), moulded from plastic, but may be formed in other ways from different materials.

So that the locating function of rib 9 will not be upset by the collector 120, the lower end of the rib 13 is formed with a rebate 148 having a depth equal to the thickness of the inner wall 129 of channel 128, into which wall 129 is received such that its exterior face 129 is flush with the outer face of the rib 9 to form part of the locating surface 13 which receives the edge piece 90 thereagainst.

A significant advantage of the described preferred embodiments is the provision of cooperating means for clamping the edge piece and locating the edge piece in a unitary structure.

Advantageously, owing to the locators in the preferred embodiments, the outer face of the edge piece and surface of the bench top can be arranged in the desired orientation, even if either or each of the mating mitres is imprecisely formed. For example, if the angle of either or each mitre is too small, the retention of edge piece against its locator during clamping forces the outer face of the edge piece into its intended angular orientation relative to the bench top and also brings the outer (visible) edges of the mating mitres together, the gap between the mitre surfaces at the interface between them varying along the mitre joint accordingly.

Whilst the use the clamps in accordance with the described embodiments involves attachment of the edge piece to the bench top when the latter is inverted, it will be appreciated that the bench top may be arranged in other orientations when the clamp is used to attach the edge piece. For example, the bench top may be arranged upright during attachment of the edge piece, and possibly even in situ.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

While various embodiments of the present invention have been described above, it should be understood that they have been presented by way of example only, and not by way of limitation. It will be apparent to a person skilled in the relevant art that various changes in form and detail can be made therein without departing from the spirit and scope of the invention. Thus, the present invention should not be limited by any of the above described exemplary embodiments.

Moreover, it will be appreciated that embodiments are possible for attaching an edge piece and bench top, table top or the like the outer and top surfaces, respectively, of which are not perpendicular.

The claims defining the invention are as follows:

1. A clamping device mountable to a bench top for setting an edge piece to an edge thereof such that the edge piece projects from the bench top at a predetermined angle, with interengaging surfaces of the edge piece and the edge being formed with mating mitres whereby a mitre joint is formed between the edge piece and the bench top, the clamping device comprising:

a body;

a first clamping member supported from the body for clamping the device to the bench top;

a second clamping member supported from the body for applying clamping pressure to the mitre joint; and a first locator and a second locator carried by the body and configured to engage the edge piece and the bench top respectively to maintain them in a required orientation during clamping, wherein the first clamping member is arranged to abut a top surface of the bench to and the second locator is arranged to abut a bottom surface of the bench to to effect the clamping of the clamping device to the bench top;

wherein the first clamping member is slidable in an axial direction with respect to the body between a retracted position, in which it is clear of the bench top, and an extended position in which it is receivable against the bench top to effect clamping of the device to the bench top, the device further comprising a quick-release locking mechanism configured to lock the clamping member in the extended position thereof;

wherein the first clamping member comprises a sleeve engageable with the locking mechanism, a rod received through the sleeve, and a clamping portion arranged at an end of the rod, the clamping portion comprising a clamping face receivable against the bench top, the sleeve and the rod having interengaging threads permitting adjustment of the position of the rod with respect to the sleeve and thus fine adjustment of the position of the clamping face relative to the bench top.

2. A clamping device according to claim 1, wherein the first locator comprises an alignment guide.

3. A clamping device according to claim 2, wherein the first locator is configured to abut slidably a face of the edge piece to maintain the required orientation during clamping.

4. A clamping device according to claim 3, wherein the first locator is configured to abut an outermost face of the edge piece slidably.

5. A clamping device according to claim 4, wherein the first locator is configured to abut the face slidably along a direction which is generally parallel to a direction in which a clamping pressure is applied.

6. A clamping device according to claim 1, wherein the axial direction is a direction perpendicular to the bench top.

7. A clamping device mountable to a bench top for setting an edge piece to an edge thereof such that the edge piece projects from the bench top at a predetermined angle, with interengaging surfaces of the edge piece and the edge being formed with mating mitres whereby a mitre joint is formed between the edge piece and the bench top, the clamping device comprising:

a body;

a first clamping member supported from the body for clamping the device to the bench top;

a second clamping member supported from the body for applying clamping pressure to the mitre joint; and a first locator and a second locator carried by the body and configured to engage the edge piece and the bench top respectively to maintain them in a required orientation during clamping, wherein the first clamping member is arranged to abut a top surface of the bench top and the second locator is arranged to abut a bottom surface of the bench top to effect the clamping of the clamping device to the bench top wherein the second clamping member is slidable in an axial direction with respect to the body between a retracted position, in which it is clear of the edge piece, and an extended position in which it is receivable against the edge piece to apply clamping pressure to the mitre joint, the device further comprising a quick-release locking mechanism configured to lock the second clamping member in the extended position thereof;

wherein the second clamping member comprises a sleeve engageable with the second clamping member locking mechanism, a rod received through the sleeve, and a clamping portion arranged at an end of the rod, the clamping portion comprising a clamping face receivable against the edge piece, the sleeve and the rod having interengaging threads permitting adjustment of the position of the rod with respect to the sleeve and thus fine adjustment of the position of the clamping face relative to the bench top.

8. A clamping device according to claim 7, wherein the body comprises a base and first and second arms which are spaced apart and extend from the base for receipt of the edge therebetween, and wherein the first clamping member is supported from the first arm and operable to effect clamping of the bench top between the first clamping member and the second arm to mount the clamping device.

9. A clamping device according to claim 8, wherein the first locator is disposed on the base.

10. A clamping device mountable to a bench top for setting an edge piece to an edge thereof such that the edge piece projects from the bench top at a predetermined angle, with interengaging surfaces of the edge piece and the edge being formed with mating mitres whereby a mitre joint is formed between the edge piece and the bench top, the clamping device comprising:

a body;

a first clamping member supported from the body for clamping the device to the bench top;

a second clamping member supported from the body for applying clamping pressure to the mitre joint; and a first locator and a second locator carried by the body and configured to engage the edge piece and the bench top respectively to maintain them in a required orientation during clamping, wherein the first clamping member is arranged to abut a top surface of the bench top and the second locator is arranged to abut a bottom surface of the bench top to effect the clamping of the clamping device to the bench top;

wherein the body comprises a base and first and second arms which are spaced apart and extend from the base for receipt of the edge therebetween, and wherein the first clamping member is supported from the first arm and operable to effect clamping of the bench top between the first clamping member and the second arm to mount the clamping device;

wherein the first locator is disposed on the base; and a retainer configured to engage the edge piece to hold the edge piece in aligned engagement with the first locator.

11. A clamping device according to claim 10, wherein the retainer is movable to push or draw the edge piece into engagement with the first locator and releasably lockable to hold the edge piece in said engagement.

12. A clamping device according to claim 11, wherein the retainer is configured to abut an innermost face of the edge piece to push or draw the edge piece against the first locator.

13. A clamping device according to claim 10, wherein the retainer is translationally adjustable in a direction of projection of the edge piece from the edge to be engageable with edge pieces of differing depth.

14. A clamping device according to claim 10, wherein the retainer is configured for rotational movement about an axis which is parallel to a longitudinal axis of the edge piece, whereby it is engageable with edge pieces which form different angles with the bench top.

15. A clamping device according to claim 10, wherein the retainer comprises a releasably lockable retaining member supported from the body and configured to extend inwardly therefrom to engage the edge piece.

* * * * *

UNITED STATES PATENT AND TRADEMARK OFFICE

CERTIFICATE OF CORRECTION

PATENT NO. : 8,991,024 B2
APPLICATION NO. : 13/202756
DATED : March 31, 2015
INVENTOR(S) : Victor Barillaro It is certified that error appears in the above-identified patent and that said Letters Patent is hereby corrected as shown below:

In column 1 (page 2, item 56, U.S. PATENT DOCUMENTS), below "2,642,905 A 6/1953 Thomas" insert --2,680,459 A * 6/1954 Dodson et al. 269/235--.

In column 1 (page 2, item 56, U.S. PATENT DOCUMENTS), below "4,165,869 A * 8/1979 Williams" insert --5,497,981 A * 3/1996 Case 269/37--.

In column 1 (page 2, item 56, U.S. PATENT DOCUMENTS), below "5,992,836 A 11/1999 Howe" insert --7,168,693 A * 1/2007 Sjuts et al. 269/37--.

In the specification

In column 12 at line 2, Change "that that" to --that--.

In the claims

In column 12 at line 35, In Claim 1, change "bench to" to --bench top--.

In column 12 at line 37, In Claim 1, change "bench to" to --bench top--.

Signed and Sealed this
Eighth Day of December, 2015

Michelle K. Lee

Michelle K. Lee
*Director of the United States Patent and Trademark Office*